US010578379B2

(12) United States Patent
DeSomma

(10) Patent No.: US 10,578,379 B2
(45) Date of Patent: Mar. 3, 2020

(54) FIREARM BOLT CARRIER ASSEMBLY KIT

(71) Applicant: Patriot Ordinance Factory, Inc., Phoenix, AZ (US)

(72) Inventor: Frank L. DeSomma, Glendale, AZ (US)

(73) Assignee: PATRIOT ORDINANCE FACTORY, INC., Phoenix, AZ (US)

( * ) Notice: Subject to any disclaimer, the term of this patent is extended or adjusted under 35 U.S.C. 154(b) by 0 days.

(21) Appl. No.: 15/342,981

(22) Filed: Nov. 3, 2016

(65) Prior Publication Data

US 2017/0153075 A1 Jun. 1, 2017

Related U.S. Application Data

(60) Provisional application No. 62/250,926, filed on Nov. 4, 2015.

(51) Int. Cl.

| | |
|---|---|
| ***F41A 3/66*** | (2006.01) |
| ***F41A 5/18*** | (2006.01) |
| ***F41A 5/24*** | (2006.01) |
| ***F41A 3/26*** | (2006.01) |
| ***F41A 3/18*** | (2006.01) |

(52) U.S. Cl.
CPC *F41A 3/66* (2013.01); *F41A 3/18* (2013.01); *F41A 3/26* (2013.01); *F41A 5/18* (2013.01); *F41A 5/24* (2013.01)

(58) Field of Classification Search
CPC ..... F41A 3/66; F41A 3/68; F41A 3/70; F41A 3/72; F41A 3/18; F41A 3/20; F41A 3/22; F41A 3/26; F41A 5/18; F41A 5/24
USPC ..... 42/14, 16, 69.01, 69.02; 89/179, 180, 89/181, 184, 185, 191.01, 191.02, 199, 11
See application file for complete search history.

(56) References Cited

U.S. PATENT DOCUMENTS

| | | | |
|---|---|---|---|
| 1,290,853 | A | 1/1919 | Sturgeon |
| 1,352,414 | A | 9/1920 | Payne |
| 1,357,208 | A | 10/1920 | Payne |
| 1,402,459 | A | 1/1922 | Gustaf |
| 1,738,501 | A | 12/1929 | Moore |
| 1,789,835 | A | 1/1931 | Pedersen |
| 1,879,603 | A | 9/1932 | Coupland |
| 1,912,757 | A | 6/1933 | Brump |
| 2,102,622 | A | 12/1937 | Green |
| 2,110,165 | A | 3/1938 | Moore |
| 2,116,141 | A | 5/1938 | Browning |

(Continued)

OTHER PUBLICATIONS

NPL-1: http://www.thefirearmblog.com/blog/2014/10/24/pof-usa-revolt-bolt-action-223-308-ar-15/ Oct. 24, 2014.*

(Continued)

*Primary Examiner* — John Cooper
(74) *Attorney, Agent, or Firm* — Snell & Wilmer, L.L.P.

(57) ABSTRACT

The present disclosure provides devices, systems, and methods for assembling a firearm bolt carrier assembly. For example, in various embodiments, a bolt carrier assembly kit comprises at least one actuation mechanism, and a bolt carrier, wherein the bolt carrier comprises an outer surface, a manual bolt actuator pocket disposed on the outer surface, and an actuation key buttress disposed on the outer surface and having a front end, a back end, and a bore extending from the front end along an axis at least partially towards the back end.

15 Claims, 8 Drawing Sheets

(56) References Cited

U.S. PATENT DOCUMENTS

| | | | |
|---|---|---|---|
| 2,124,075 | A | 7/1938 | Moore |
| 2,287,066 | A | 6/1942 | Rogers |
| 2,391,864 | A | 1/1946 | Chandler |
| 2,437,548 | A | 3/1948 | William |
| 2,467,372 | A | 4/1949 | De Permentier |
| 2,482,880 | A | 9/1949 | Sefried |
| 2,570,292 | A | 10/1951 | Umsted |
| 2,816,484 | A | 12/1957 | Grages |
| 2,935,912 | A | 5/1960 | Hartley |
| 3,051,057 | A | 8/1962 | Ivy |
| 3,071,225 | A | 1/1963 | Blau et al. |
| 3,118,243 | A | 1/1964 | Manshel |
| 3,301,133 | A | 1/1967 | Sturtevant |
| 3,455,204 | A | 7/1969 | Stoner |
| 3,675,534 | A | 7/1972 | Beretta |
| 3,724,325 | A | 4/1973 | Silsby |
| 3,736,693 | A | 6/1973 | Koch |
| 3,908,214 | A | 9/1975 | DoLoreto |
| 3,943,821 | A | 3/1976 | Seifried |
| 4,057,924 | A | 11/1977 | Joseph |
| 4,244,273 | A | 1/1981 | Langendorfer |
| 4,246,830 | A | 1/1981 | Krieger |
| 4,521,985 | A | 6/1985 | Smith et al. |
| 4,536,982 | A | 8/1985 | Bredbury |
| 4,576,083 | A | 3/1986 | Seberger |
| H107 | H | 8/1986 | Bauer |
| D285,236 | S | 8/1986 | Brunton |
| 4,651,455 | A | 3/1987 | Geiser |
| 4,658,702 | A | 4/1987 | Tatro |
| 4,663,875 | A | 5/1987 | Tatro |
| 4,759,144 | A | 7/1988 | Egan et al. |
| 4,765,224 | A | 8/1988 | Morris |
| 4,937,964 | A | 7/1990 | Crandall |
| D329,078 | S | 9/1992 | Hasselbusch |
| 5,183,959 | A | 2/1993 | Mc Coan et al. |
| 5,272,956 | A | 12/1993 | Hudson |
| 5,343,650 | A | 9/1994 | Swan |
| 5,351,598 | A | 10/1994 | Schuetz |
| 5,386,659 | A | 2/1995 | Vaid et al. |
| 5,479,737 | A | 1/1996 | Osborne et al. |
| 5,543,787 | A | 8/1996 | Karidis et al. |
| 5,551,179 | A | 9/1996 | Young |
| 5,590,484 | A | 1/1997 | Mooney |
| 5,634,288 | A | 6/1997 | Martel |
| 5,726,377 | A | 3/1998 | Harris et al. |
| 5,770,814 | A | 6/1998 | Ealovega |
| D399,914 | S | 10/1998 | Walker |
| 5,827,992 | A | 10/1998 | Harris et al. |
| 5,930,935 | A | 8/1999 | Griffin |
| 5,983,774 | A | 11/1999 | Mihaita |
| 6,070,352 | A | 6/2000 | Daigle |
| 6,113,285 | A | 9/2000 | Ward |
| 6,209,250 | B1 | 4/2001 | Mills |
| 6,217,205 | B1 | 4/2001 | Ward |
| D447,791 | S | 9/2001 | Robidoux |
| 6,308,448 | B1 | 10/2001 | Kapusta et al. |
| 6,345,460 | B2 | 2/2002 | Hashman |
| 6,347,474 | B1 | 2/2002 | Wolff |
| D462,105 | S | 8/2002 | Myers |
| 6,470,615 | B1 | 10/2002 | Peterken |
| 6,490,822 | B1 | 12/2002 | Swan |
| 6,508,027 | B1 | 1/2003 | Kim |
| 6,508,159 | B1 | 1/2003 | Muirhead |
| D477,855 | S | 7/2003 | Selvaggio |
| 6,606,812 | B1 | 8/2003 | Gwinn |
| 6,634,274 | B1 | 10/2003 | Herring |
| 6,681,677 | B2 | 1/2004 | Herring |
| 6,694,660 | B1 | 2/2004 | Davies |
| 6,722,072 | B1 | 4/2004 | McCormick et al. |
| 6,722,255 | B2 | 4/2004 | Herring |
| 6,779,288 | B1 | 8/2004 | Kim |
| 6,827,130 | B2 | 12/2004 | Larson |
| 6,839,998 | B1 | 1/2005 | Armstrong |
| 6,848,351 | B1 | 2/2005 | Davies |
| 6,854,206 | B2 | 2/2005 | Oz |
| D504,168 | S | 4/2005 | McCormick |
| 6,921,181 | B2 | 7/2005 | Yen |
| 6,971,202 | B2 | 12/2005 | Bender |
| 7,051,467 | B1 | 5/2006 | Huber |
| 7,131,228 | B2 | 11/2006 | Hochstrate et al. |
| D544,063 | S | 6/2007 | Swan |
| 7,316,091 | B1 | 1/2008 | Desomma |
| 7,363,741 | B2 | 4/2008 | Desomma |
| 7,418,898 | B1 | 9/2008 | Desomma |
| 7,421,937 | B1 | 9/2008 | Gangl |
| 7,464,496 | B1 | 12/2008 | Davies |
| D590,473 | S | 4/2009 | Fitzpatrick et al. |
| D593,617 | S | 6/2009 | Dochterman |
| 7,584,567 | B1 | 9/2009 | Desomma |
| 7,600,338 | B2 | 10/2009 | Geissele |
| D604,793 | S | 11/2009 | Fitzpatrick et al. |
| 7,753,679 | B1 | 7/2010 | Schuetz |
| 7,784,211 | B1 | 8/2010 | Desomma |
| D624,609 | S | 9/2010 | Stein et al. |
| 7,798,045 | B1 | 9/2010 | Fitzpatrick et al. |
| 7,827,722 | B1 | 11/2010 | Davies |
| D629,062 | S | 12/2010 | Peterson et al. |
| 7,856,917 | B2 | 12/2010 | Noveske |
| D630,698 | S | 1/2011 | Peterson et al. |
| D631,933 | S | 2/2011 | Thompson |
| 7,891,284 | B1 | 2/2011 | Barrett |
| 7,905,041 | B1 | 3/2011 | Davies |
| 7,930,968 | B2 | 4/2011 | Giefing |
| D643,086 | S | 8/2011 | Peterson et al. |
| D645,532 | S | 9/2011 | Peterson et al. |
| 8,056,460 | B2 | 11/2011 | Herring |
| 8,091,265 | B1 | 1/2012 | Teetzel |
| 8,161,864 | B1 | 4/2012 | Vuksanovich |
| 8,230,634 | B1 | 7/2012 | Davies |
| 8,261,653 | B2 | 9/2012 | Crommett |
| 8,359,966 | B1 | 1/2013 | Brotherton |
| 8,375,616 | B2 * | 2/2013 | Gomez ..... F41A 3/26 42/16 |
| 8,381,628 | B1 | 2/2013 | Wheatley |
| 8,479,428 | B1 | 7/2013 | Desomma |
| D708,693 | S | 7/2014 | Faxon |
| D713,483 | S | 9/2014 | Firpo |
| 8,826,797 | B2 | 9/2014 | Overstreet |
| 8,844,424 | B2 * | 9/2014 | Gomez ..... F41A 3/26 89/132 |
| D716,404 | S | 10/2014 | Capps |
| 8,863,637 | B2 | 10/2014 | Hall |
| 8,869,674 | B2 | 10/2014 | Ruck |
| D717,904 | S | 11/2014 | Oglesby |
| 8,875,614 | B2 | 11/2014 | Gomez |
| D720,032 | S | 12/2014 | Boutin |
| 8,910,406 | B1 | 12/2014 | Huang |
| 8,978,282 | B2 | 3/2015 | Garrett |
| 9,032,860 | B2 | 5/2015 | Faxon |
| D741,978 | S | 10/2015 | Shea |
| 9,194,638 | B2 | 11/2015 | Larson et al. |
| D745,621 | S | 12/2015 | Huang |
| D748,754 | S | 2/2016 | Chastain |
| D750,725 | S | 3/2016 | Capps |
| 9,291,412 | B1 | 3/2016 | Montes |
| 9,303,949 | B1 | 4/2016 | Oglesby |
| D755,339 | S | 5/2016 | Geissele |
| D757,199 | S | 5/2016 | Bender |
| D760,860 | S | 7/2016 | Vincent |
| D763,397 | S | 8/2016 | Huang |
| D764,004 | S | 8/2016 | Bender |
| 9,423,194 | B2 | 8/2016 | Fritz |
| 9,429,375 | B2 | 8/2016 | DeSomma |
| D768,801 | S | 10/2016 | Morris |
| D771,767 | S | 11/2016 | Niswander |
| 9,523,557 | B2 | 12/2016 | Sharron |
| 9,523,558 | B2 | 12/2016 | Visinski |
| 9,528,793 | B1 | 12/2016 | Oglesby |
| D777,285 | S | 1/2017 | Bender |
| 10,012,462 | B2 | 7/2018 | DeSomma |
| 2003/0010186 | A1 | 1/2003 | Muirhead |
| 2003/0010187 | A1 | 1/2003 | Muirhead |
| 2004/0064994 | A1 | 4/2004 | Luke |
| 2004/0226212 | A1 | 11/2004 | Shiloni |

(56) References Cited

U.S. PATENT DOCUMENTS

| | | | |
|---|---|---|---|
| 2005/0000142 | A1 | 1/2005 | Kim et al. |
| 2005/0223613 | A1 | 10/2005 | Bender |
| 2005/0241211 | A1 | 11/2005 | Swan |
| 2005/0262752 | A1 | 12/2005 | Robinson et al. |
| 2005/0262997 | A1 | 12/2005 | Brixius |
| 2006/0026883 | A1 | 2/2006 | Hochstrate et al. |
| 2006/0010748 | A1 | 6/2006 | Stoner et al. |
| 2006/0236582 | A1 | 10/2006 | Lewis et al. |
| 2006/0265925 | A1 | 11/2006 | Murello |
| 2006/0265926 | A1 | 11/2006 | Sietsema |
| 2006/0277810 | A1 | 12/2006 | Leitner-Wise |
| 2007/0006509 | A1 | 1/2007 | Desomma et al. |
| 2007/0033851 | A1 | 2/2007 | Hochstrate et al. |
| 2007/0051236 | A1 | 3/2007 | Groves et al. |
| 2007/0079539 | A1 | 4/2007 | Karagias |
| 2007/0180984 | A1 | 8/2007 | Huther |
| 2007/0199435 | A1 | 8/2007 | Hochstrate et al. |
| 2007/0169393 | A1 | 12/2007 | Frost |
| 2008/0078284 | A1 | 4/2008 | Murello |
| 2009/0223357 | A1 | 9/2009 | Herring |
| 2009/0249672 | A1 | 10/2009 | Zedrosser |
| 2009/0313873 | A1 | 12/2009 | Roth |
| 2010/0000400 | A1 | 1/2010 | Brown |
| 2010/0251591 | A1 | 10/2010 | Burt |
| 2010/0307042 | A1 | 12/2010 | Jarboe |
| 2010/0319231 | A1 | 12/2010 | Stone et al. |
| 2010/0319527 | A1 | 12/2010 | Giefing |
| 2011/0000119 | A1 | 1/2011 | Desomma |
| 2011/0016762 | A1 | 1/2011 | Davies |
| 2011/0056107 | A1 | 3/2011 | Underwood |
| 2011/0214327 | A1 | 9/2011 | Desomma |
| 2011/0265638 | A1 | 11/2011 | Overstreet |
| 2011/0271827 | A1 | 11/2011 | Larson |
| 2011/0283580 | A1 | 11/2011 | Esch |
| 2012/0117845 | A1 | 5/2012 | Desomma |
| 2012/0167757 | A1 | 7/2012 | Gomez |
| 2012/0174451 | A1 | 7/2012 | Overstreet |
| 2012/0260793 | A1 | 10/2012 | Gomez |
| 2012/0297656 | A1 | 11/2012 | Langevin |
| 2013/0098235 | A1 | 4/2013 | Reinken |
| 2013/0174721 | A1 | 7/2013 | Langevin |
| 2013/0219763 | A1 | 8/2013 | Nunes |
| 2013/0220295 | A1 | 8/2013 | Wood et al. |
| 2013/0227869 | A1 | 9/2013 | Thordsen |
| 2014/0000142 | A1 | 1/2014 | Patel |
| 2014/0060312 | A1 | 3/2014 | Ruck |
| 2014/0075804 | A1 | 3/2014 | Langevin |
| 2014/0090283 | A1* | 4/2014 | Gomez ..... F41A 3/26 42/25 |
| 2014/0115938 | A1 | 7/2014 | Jarboe |
| 2014/0076149 | A1 | 8/2014 | Adams |
| 2014/0224114 | A1 | 8/2014 | Faxon |
| 2014/0260945 | A1 | 9/2014 | Desomma |
| 2014/0311007 | A1 | 10/2014 | Capps |
| 2014/0352191 | A1 | 12/2014 | Fritz |
| 2015/0007476 | A1 | 1/2015 | Dextraze |
| 2015/0040455 | A1 | 2/2015 | Lewis |
| 2015/0168092 | A1 | 6/2015 | Stone |
| 2015/0198409 | A1 | 7/2015 | Desomma |
| 2015/0226501 | A1 | 8/2015 | Gibbens |
| 2015/0253091 | A1 | 9/2015 | Gardner |
| 2015/0323269 | A1 | 11/2015 | McGinty |
| 2015/0330733 | A1 | 11/2015 | Desomma |
| 2015/0345879 | A1 | 12/2015 | Jen |
| 2015/0362270 | A1 | 12/2015 | Stewart |
| 2015/0369558 | A1 | 12/2015 | Gottzmann |
| 2016/0209137 | A1 | 7/2016 | DeSomma |
| 2016/0209138 | A1 | 7/2016 | DeSomma |
| 2016/0178297 | A1 | 12/2016 | Sharps |
| 2017/0051989 | A1 | 2/2017 | DeSomma |
| 2017/0307321 | A1 | 10/2017 | DeSomma |

OTHER PUBLICATIONS

NPL-2: http://www.rifleshootermag.com/reviews/pof-usa-revolt-review/ Jul. 9, 2015.*

NPL-3: http://www.gunsandammo.com/rifles/ar-15/review-pof-revolt-rifle/ May 2, 2016.*

USPTO; Non-Final Office Action dated Dec. 1, 2016 in U.S. Appl. No. 13/835,842.

USPTO; Final Office Action dated Dec. 27, 2016 in U.S. Appl. No. 15/002,096.

USPTO; Notice of Allowance dated Jan. 11, 2017 in U.S. Appl. No. 29/551,847.

Rainer Arms Forged Mil-Spec Upper Minus FA 9mm / .22 LR, RainierArms.com, [online], [site visited Dec. 30, 2016]. <URL: http://www.rainierarms.com/rainier-arms-forged-mil-spec-upper-minus-fa-22-lr>.

Rainer Arms Forged A4 Upper Receiver-GEN2, RainierArms.com, [online], [site visited Dec. 30, 2016]. <URL: http://www.rainierarms.com/rainier-arms-forged-A4-upper-receiver-gen2>.

Rainer Arms Forged Mil-Spec Upper Minus FA 1/LOGO, RainierArms.com, [online], [site visited Dec. 30, 2016]. <URL: http://www.rainierarms.com/rainier-arms-forged-mil-spec-upper-minus-fa-w-logo>.

BCM M4 Arms Upper Receiver Assembly, RainierArms.com, [online], [site visited Dec. 30, 2016]. <URL: http://www.rainierarms.com/bcm-m4-upper-receiver-assembly>.

NorthTech Defense Non Forward Assist AR15 Billet Upper Receiver, RainierArms.com, [online], [site visited Dec. 30, 2016]. <URL: http://www.rainierarms.com/northtech-defense-non-forward-assist-ar15-billet-upper-receiver>.

SAAAR 15 Stripped Flat Top Upper Receiever—No Mark, SurplusAmmo.com, [online], [site visited Dec. 30, 2016]. <URL: http://www.surplusammo.com/saa-ar15-stripped-flat-top-upper-receiver-no-mark/>.

Aero Precision Assembled AR-15 Upper receiever with Port Door and Forward Assist, PrimaryArms.com, [online], [site visited Dec. 30, 2016]. URL: http://www.primaryarms.com/aero-precision-assembled-ar-15-upper-receiver-with-port-door-and-forward-assist-ap501603-asmbly>.

Anderson Manufacturing AR-15 Stripped Upper Receiver, PrimaryArms.com, [online], [site visited Dec. 30, 2016]. <URL: http://www.primaryarms.com/anderson-manufacturing-ar-15-stripped-upper-receiver-ar-15-a3-upfor-um>.

Vltor MUR Modular Upper Receiver with Shell Deflector Only Assembled AR-15 Matte, MidwayUSA.com, [online], [site visited Dec. 30, 2016]. <URL: http://www.midwayusa.com/product/478529/vltor-mur-modular-upper-receiver-with-shell-leflector-only-assembled-ar-15-matte>.d LanTac USA LA00221 AR-15 UAR Stripped Upper Receiver 5.56mm Black, TombStoneTactical.com, [online], [site visited Dec. 13, 2016]. <URL: http://www.tombstonetactical.com/catalog/lantac-usa/la00221-ar15-uar-stripped-upper-receiver-5.56mm-black/>.

AR15-A3 Stripped Upper Receiver, FrederickArms.com, [online], [site visited Dec. 30, 2016]. <URL:http://www.frederickarms.com/ar15-a3-stripped-upper-receiver.html>.

Upper Receiver AR-15, CrossHairCustoms.com, [online], [site visited Dec. 30, 2016]. <URL: http://www.crosshaircustoms.com'/product/ar-15-upper-receiver/>.

USPTO; Restriction Requirement Office Action dated Jan. 27, 2017 in U.S. Appl. No. 15/002,382.

USPTO; Notice of Allowance dated Mar. 30, 2017 in U.S. Appl. No. 29/551,237.

USPTO; Non-Final Office Action dated Apr. 10, 2017 in U.S. Appl. No. 15/002,096.

USPTO; Final Office Action dated May 19, 2017 in U.S. Appl. No. 15/002,382.

USPTO; Non-Final Office Action dated Jun. 13, 2017 in U.S. Appl. No. 15/250,218.

USPTO; Final Office Action dated Jun. 28, 2017 in U.S. Appl. No. 13/835,842.

USPTO; Restriction Requirement dated Jul. 25, 2007 in U.S. Appl. No. 11/056,306.

USPTO; Non-Final Office Action dated Oct. 10, 2007 in U.S. Appl. No. 11/056,306.

(56) References Cited

OTHER PUBLICATIONS

USPTO; Notice of Allowance dated May 9, 2008 in U.S. Appl. No. 11/056,306.
USPTO; Restriction Requirement dated Nov. 15, 2006 in U.S. Appl. No. 11/174,270.
USPTO; Non-Final Office Action dated Mar. 15, 2007 in U.S. Appl. No. 11/174,270.
USPTO; Final Office Action dated Sep. 26, 2007 in U.S. Appl. No. 11/174,270.
USPTO; Notice of Allowance dated Jan. 14, 2008 in U.S. Appl. No. 11/174,270.
USPTO; Non-Final Office Action dated Jan. 18, 2007 in U.S. Appl. No. 11/232,521.
USPTO; Final Office Action dated Jun. 15, 2007 in U.S. Appl. No. 11/232,521.
USPTO; Notice of Allowance dated Aug. 15, 2007 in U.S. Appl. No. 11/232,521.
USPTO; Non-Final Office Action dated Apr. 29, 2008 in U.S. Appl. No. 11/442,035.
USPTO; Notice of Allowance dated Sep. 30, 2008 in U.S. Appl. No. 11/442,035.
USPTO; Non-Final Office Action dated Dec. 27, 2007 in U.S. Appl. No. 11/527,851.
USPTO; Final Office Action dated Aug. 13, 2008 in U.S. Appl. No. 11/527,851.
USPTO; Non-Final Office Action dated Mar. 3, 2009 in U.S. Appl. No. 11/527,851.
USPTO; Final Office Action dated Sep. 1, 2009 in U.S. Appl. No. 11/527,851.
USPTO; Notice of Allowance dated Mar. 29, 2013 in U.S. Appl. No. 11/527,851.
USPTO; Non-Final Office Action dated Dec. 14, 2009 in U.S. Appl. No. 11/947,294.
USPTO; Notice of Allowance dated May 5, 2010 in U.S. Appl. No. 11/947,294.
USPTO; Non-Final Office Action dated Dec. 11, 2008 in U.S. Appl. No. 12/110,304.
USPTO; Notice of Allowance dated May 29, 2009 in U.S. Appl. No. 12/110,304.
USPTO; Non-Final Office Action dated Nov. 24, 2010 in U.S. Appl. No. 12/489,592.
USPTO; Notice of Allowance dated Mar. 3, 2011 in U.S. Appl. No. 12/489,592.
USPTO; Non-Final Office Action dated Feb. 17, 2013 in U.S. Appl. No. 12/497,048.
USPTO; Non-Final Office Action dated Feb. 15, 2012 in U.S. Appl. No. 13/098,196.
USPTO; Final Office Action dated Jun. 11, 2012 in U.S. Appl. No. 13/098,196.
USPTO; Non-Final Office Action dated Feb. 21, 2012 in U.S. Appl. No. 13/105,893.
USPTO; Final Office Action dated Apr. 13, 2012 in U.S. Appl. No. 13/105,893.
USPTO; Advisory Action dated Apr. 26, 2012 in U.S. Appl. No. 13/105,893.
USPTO; Notice of Allowance dated Jun. 22, 2012 in U.S. Appl. No. 13/105,893.
USPTO; Non-Final Office Action dated Feb. 15, 2012 in U.S. Appl. No. 13/358,347.
USPTO; Non-Final Office Action dated Jun. 6, 2012 in U.S. Appl. No. 13/358,347.
USPTO; Non-Final Office Action dated Feb. 27, 2013 in U.S. Appl. No. 13/708,025.
USPTO; Final Office Action dated Sep. 26, 2013 in U.S. Appl. No. 13/708,025.
USPTO; Non-Final Office Action dated Dec. 17, 2013 in U.S. Appl. No. 13/835,842.
USPTO; Final Office Action dated Jun. 4, 2014 in U.S. Appl. No. 13/835,842.
USPTO; Non-Final Office Action dated Oct. 24, 2014 in U.S. Appl. No. 13/835,842.
USPTO; Final Office Action dated Jun. 18, 2015 in U.S. Appl. No. 13/835,842.
USPTO; Non-Final Office Action dated Jan. 5, 2016 in U.S. Appl. No. 13/835,842.
USPTO; Final Office Action dated Jun. 1, 2016 in U.S. Appl. No. 13/835,842.
USPTO; Non-Final Office Action dated Jan. 29, 2015 in U.S. Appl. No. 14/216,733.
USPTO; Final Office Action dated Jul. 16, 2015 in U.S. Appl. No. 14/216,733.
USPTO; Non-Final Office Action dated Jan. 14, 2016 in U.S Appl. No. 14/527,698.
USPTO; Notice of Allowance dated Apr. 25, 2016 in U.S Appl. No. 14/527,698.
USPTO; Non-Final Office Action dated Aug. 17, 2015 in U.S. Appl. No. 14/596,018.
USPTO; Non-Final Office Action dated Jun. 23, 2016 in U.S. Appl. No. 15/002,096.
USPTO; Non-Final Office Action dated Jun. 22, 2016 in U.S. Appl. No. 15/002,382.
USPTO; Restriction Requirement dated Apr. 24, 2014 in U.S. Appl. No. 29/449,556.
USPTO; Notice of Allowance dated Jul. 7, 2014 in U.S. Appl. No. 29/449,556.
USPTO; Notice of Allowance dated Oct. 13, 2015 in U.S. Appl. No. 29/502,433.
POF-USA Patriot Ordnance Factory, Inc., Upper Receiver web page, Retrieved from http://web.archive.org/web/20100922070336/http://www.pof-usa.com/upper/upperreceiver.html[Sep. 17, 2012 9:19:17 AM].
USPTO; Final Office Action dated Sep. 28, 2017 in U.S. Appl. No. 15/002,096.
USPTO; Restriction Requirement Office Action dated Oct. 31, 2017 in U.S. Appl. No. 15/410,534.
USPTO; Office Action dated Jan. 9, 2018 in U.S. Appl. No. 13/835,842.
USPTO; Office Action dated Dec. 12, 2017 in U.S. Appl. No. 15/002,382.
USPTO; Office Action dated Jan. 18, 2018 in U.S. Appl. No. 15/410,534.
USPTO; Notice of Allowance dated Mar. 26, 2018 in U.S. Appl. No. 15/002,096.
USPTO; Notice of Allowance dated Mar. 29, 2018 in U.S. Appl. No. 15/250,218.
USPTO; Notice of Allowance dated Jul. 18, 2018 in U.S. Appl. No. 15/410,534.
USPTO; Final Office Action dated Aug. 27, 2018 in U.S. Appl. No. 13/835,842.
USPTO; Notice of Allowance dated Sep. 20, 2018 in U.S. Appl. No. 15/002,382.
USPTO; Non-Final Office Action dated Sep. 28, 2018 in U.S. Appl. No. 16/025,593.
USPTO; Notice of Allowance dated Mar. 6, 2019 in U.S. Appl. No. 16/025,593.
Always Armed, "First AR Build (for myself that is)", Mar. 23, 2014, MossbergOwners.com, <http://mossergowners.com/forum/index.php?threads/first-ar-build-for-myslef-that-is.11491/page-4>, Entire thread, Accessed Sep. 22, 2017.
Paulo_Santos, PWS & POF Enhanced Buffer Tube Review, Feb. 9, 2011, Weapon Evolution, <http://www.weaponevolution.com/forum/showthread.php?3005-PWS-amp-POF-Enhanced-Buffer-Tube-Reviews>, Entire thread, Accessed Sep. 22, 2017.
USPTO; Non-Final Office Action dated Mar. 14, 2019 in U.S. Appl. No. 13/835,842.
USPTO; Non-Final Office Action dated Mar. 14, 2019 in U.S. Appl. No. 16/032,940.

* cited by examiner

SECTION C-C

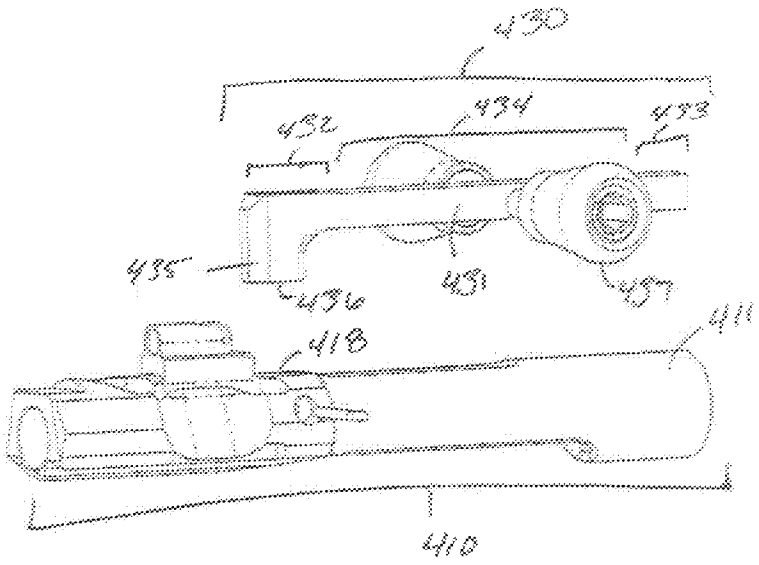
420
422
424
426
428
430
432
434
436
438
440
442
444
446
448
450
452
454
456
458
460
462
464
466
468
470
472
474
476
478
480
482
484
486
488
490
492
494
496
498
500

FIREARM BOLT CARRIER ASSEMBLY KIT

CROSS-REFERENCE TO RELATED APPLICATION

This application claims priority to, and the benefit of, U.S. Provisional Patent Application No. 62/250,926 filed on Nov. 4, 2015 entitled "FIREARM BOLT CARRIER ASSEMBLY KIT". The content of the foregoing application is hereby incorporated by reference for all purposes.

FIELD OF THE DISCLOSURE

The disclosure relates to devices, systems, and methods for assembling a firearm bolt carrier assembly. More specifically, the disclosure relates to a bolt carrier configured for assembly with a variety of bolt actuation mechanisms, as well as associated systems and methods.

BACKGROUND OF THE DISCLOSURE

Conventional firearms may incorporate any one of a variety of actuation systems including, for example, gas piston systems, gas impingement systems, manual actuation systems, and the like. Typically, various firearm components are not interchangeable as between firearms having different actuation systems.

SUMMARY OF THE DISCLOSURE

In various embodiments, a bolt carrier assembly kit for firearms is provided. The bolt carrier assembly kit may comprise at least one actuation mechanism and a bolt carrier, wherein the bolt carrier comprises an outer surface, a manual bolt actuator pocket disposed on the outer surface, and an actuation key buttress disposed on the outer surface and having a front end, a back end, and a bore extending from the front end at least partially along an axis towards the back end. In various embodiments, the actuation mechanism may comprise a manual bolt actuator. In various embodiments, the actuation mechanism may comprise an attachment mechanism and an actuation key.

In various embodiments, a bolt, carrier may comprise an outer surface, a manual bolt actuator pocket disposed on the outer surface, and an actuation key buttress, wherein the actuation key buttress is disposed on the outer surface and has a front end, a back end, and a bore extending from the front end at least partially along an axis towards the back end. In various embodiments the actuation key buttress may further comprise a buttress pin aperture. In various embodiments, the manual bolt actuator pocket may be defined by a surrounding wall having substantially the same profile as a joining face of a manual bolt actuator. In various embodiments, the bolt carrier may be configured to be operatively coupled to and detachable from at least one of an actuation key and a manual bolt actuator.

In various embodiments, a method of assembling a bolt carrier assembly may comprise providing a bolt carrier assembly kit, determining to assemble a first bolt carrier assembly comprising at least one of a manual bolt firearm bolt carrier assembly, a direct impingement firearm bolt carrier assembly, and a gas piston firearm bolt carrier assembly. The method may further comprise selecting bolt carrier assembly components, and assembling the first bolt carrier assembly. In various embodiments, the method may further comprise determining a first type of firearm with which the first bolt carrier assembly is compatible, disassembling the first bolt carrier assembly, selecting bolt carrier assembly components compatible with a second type of firearm, and assembling a second bolt carrier assembly.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

FIG. 4A illustrates a perspective view of an unassembled bolt carrier assembly kit.

DETAILED DESCRIPTION

The detailed description of exemplary embodiments herein makes reference to the accompanying drawings, which show exemplary embodiments by way of illustration and their best mode. While these exemplary embodiments are described in sufficient detail to enable those skilled in the art to practice the inventions, it should be understood that other embodiments may be realized and that logical, chemical and mechanical changes may be made without departing from the spirit and scope of the inventions. Thus, the detailed description herein is presented for purposes of illustration only and not of limitation.

For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

In the context of the present disclosure, devices, systems, and methods may find particular use in connection with rotating bolt firearms. However, various aspects of the disclosed embodiments may extend to all types of applications and to all types of firearms including, without limitation, automatic firearms, semi-automatic firearms, bolt action firearms, and/or the like. Similarly, the present disclosure may extend to firearms using any suitable action including, for example, rotating bolt firearms, and to any suitable actuation system including, for exam, gas piston systems, gas impingement systems, manual actuation systems, and/or the like.

Figure 1:
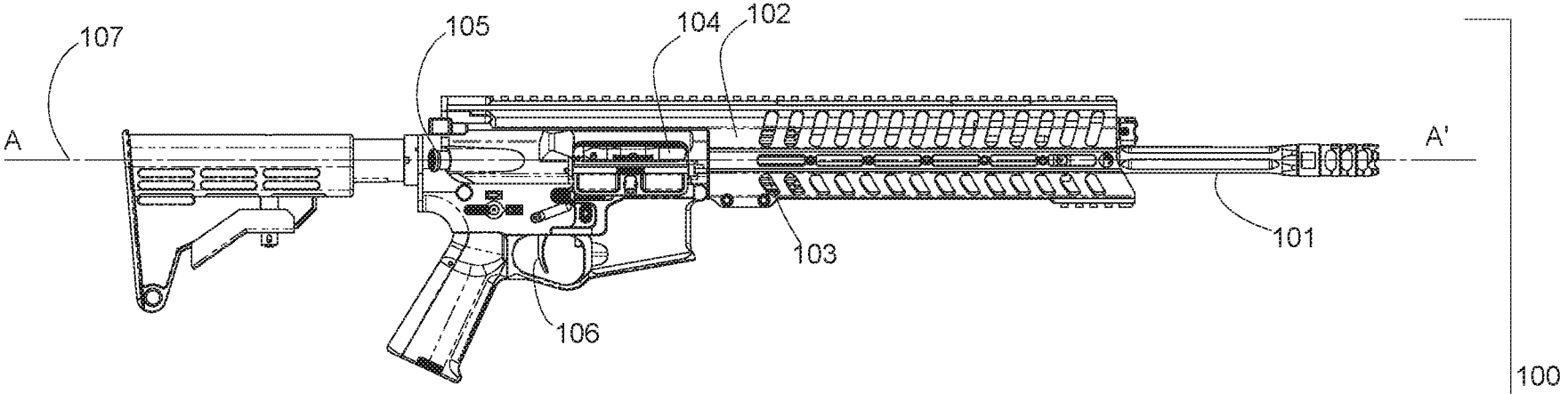
FIG. 1 illustrates a cross-section view of a firearm.

Referring to FIG. 1, a firearm 100 is illustrated according to various embodiments. Firearm 100 may comprise a barrel 101, a receiver body 102, a barrel nut 103, a bolt carrier 104, a forward assist 105, and a trigger assembly 106. Firearm 100 may extend along a firearm axis 107, marked A-A', with A being located near a rear end of firearm 100 and A' being located near a forward end of firearm 100. As used herein, movement and/or translation in a direction towards A along firearm axis 107 and/or parallel to firearm axis 107 may be referred to as movement and/or translation in a rearward direction; movement and/or translation in a direction towards A' along firearm axis 107 and/or parallel to firearm axis 107 may be referred to as movement and/or translation in a forward direction. As used herein, the term "length" should be understood to describe an axial, linear distance along or substantially parallel to firearm axis 107; the term "width" should be understood to describe a linear distance substantially perpendicular to firearm axis 107 and/or an axis substantially parallel to firearm axis 107.

Generally speaking, the operation of firearm 100 may proceed in a cycle. A first round of ammunition may be struck with a firing pin, igniting gun powder and causing a bullet to move forward through barrel 101 as gas expands behind the bullet. In a manual bolt action firearm, expanding gas escapes through barrel 101 after the bullet exits barrel 101, and bolt 103 and bolt carrier 104 are manually translated in a rearward direction to cause ejection of an ammunition cartridge from firearm 100 and chambering of a second round of ammunition. In an automatic and/or semi-automatic firearm, the expanding gas may cause bolt 103 and bolt carrier 104 to be translated in a rearward direction, causing ejection of the ammunition cartridge from firearm 100, and chambering of a second round of ammunition.

For example, in a direct impingement firearm, a portion of the expanding gas is bled from barrel 101, is translated in a rearward direction through a chamber, and applies force directly on bolt carrier 104, moving bolt 103 in a rearward direction. In a gas piston firearm, a portion of the expanding gas is bled from barrel 101 into a piston cylinder, wherein the expanding gas pushes a piston in a rearward direction. The piston then acts on a piston rod, which strikes bolt carrier 104, moving bolt 103 in a rearward direction, FIG. 1 provides a general understanding of the operation of a rotating bolt firearm, and is not intended to limit the disclosure.

In various embodiments, a bolt carrier assembly kit is provided. A bolt carrier assembly kit may comprise a bolt carrier and at least one actuation mechanism. The bolt carrier may be configured to alternatively couple to various actuation mechanisms. Such actuation mechanisms may be configured for operation in a variety of firearms including, without limitation, automatic or semiautomatic gas piston firearms, automatic or semiautomatic direct impingement firearms, and/or manual bolt firearms. Manufacturing efficiencies may be achieved through production of t single bolt carrier capable of assembly in a variety of firearms. Additionally, modular and interchangeable firearm components are desirable to consumers and intermediate distributors because they may increase functionality (i.e., a single component may be used in a variety of firearms) and create cost efficiencies (i.e., components may be individually replaced and firearms may be configured or reconfigured to meet changing consumer demand).

Figure 2A:
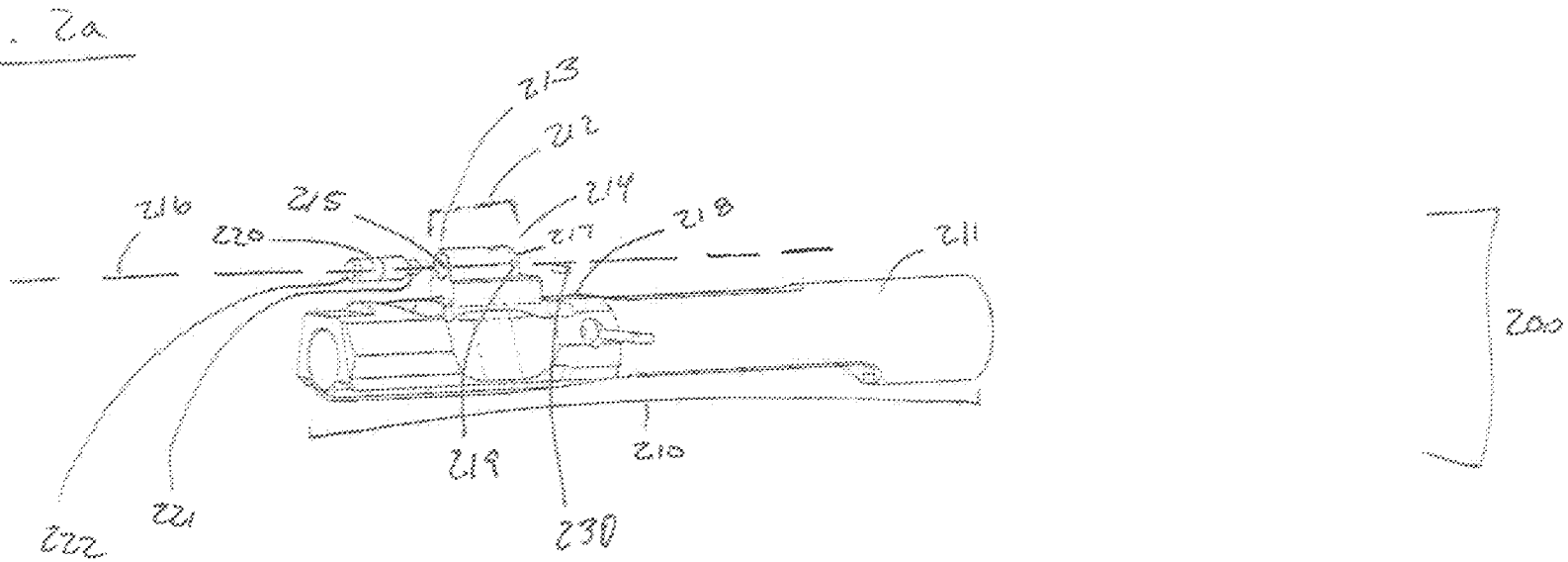
FIG. 2A illustrates a perspective view of an unassembled bolt carrier assembly kit.
Figure 2C:
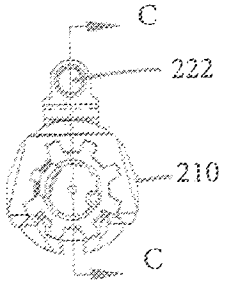
FIG. 2C illustrates a front view of an assembled holt carrier assembly kit.
Figure 2B:
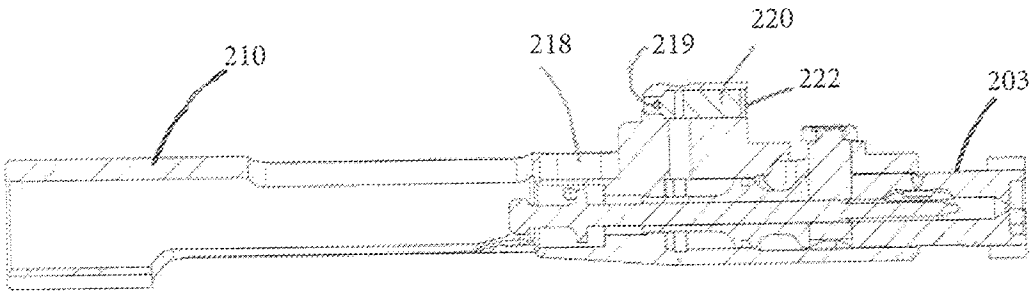
FIG. 2B illustrates a cross-section view of an assembled bolt carrier assembly kit.

In various embodiments and with reference to FIGS. 2A, 2B, and 2C, a bolt carrier assembly kit 200 may comprise a bolt carrier 210 and an actuation mechanism. Bolt carrier 210 may be configured to carry bolt 203 and guide it within receiver body 102 (with momentary reference to FIG. 1). Bolt carrier 210 may comprise an outer surface 211 configured to at least partially surround a bolt carrier chamber. In various embodiments, bolt carrier 210 may further comprise an actuation key buttress 212 disposed on outer surface 211, and a manual bolt actuator pocket 218 disposed on outer surface 211.

Manual bolt actuator pocket 218 may be configured to receive a portion of a manual bolt actuator (discussed below). In various embodiments, manual bolt actuator pocket 218 may comprise a recess or depression in outer surface 211. In various embodiments, manual bolt actuator pocket 218 may be defined by a surrounding wall and/or a profile. In various embodiments, the surrounding wall may define a depth of manual bolt actuator pocket 218 extending from outer surface 211 in an inward direction towards the bolt carrier chamber. In various embodiments, the profile may define a surface area of the manual bolt actuator pocket 218 at least partially surrounded by the surrounding call. In various embodiments, the profile may define the volume and/or three-dimensional shape of manual bolt actuator pocket 218. In various embodiments, the profile may be rectangular in shape. However, the profile may be circular, elliptical, triangular, cuboidal, cylindrical, conical, pyramidal, or any other suitable shape.

In various embodiments, manual bolt actuator pocket 218 may be disposed rearward of actuation key buttress 212. In various embodiments, manual bolt actuator pocket 218 may be axially aligned with actuation key buttress 212 along firearm axis 107 (with momentary reference to FIG. 1). In various embodiments, the manual bolt actuator pocket 218 may be radially aligned with the actuation key buttress 212. In various embodiments, manual bolt actuator pocket 218 may be disposed on actuation key buttress 212. However, manual bolt actuator pocket 218 may be disposed in any suitable position on bolt carrier 210.

Actuation key buttress 212 may be configured to receive an actuation key (discussed below) configured to receive an impact from pressurized gas or a mechanical component of firearm 100. In various embodiments, actuation key buttress 212 may be integral to bolt carrier 210.

In various embodiments, actuation key buttress 212 may comprise a front end 213, a back end 214, and a bore 215 extending in a rearward direction from front end 213 along a buttress axis 214 at least partially towards back end 214. Buttress axis 216 may be substantially parallel to firearm axis 107 (with momentary reference to FIG. 1). In various embodiments, bore 215 may define a space that is generally cylindrical in shape, conical in shape, or any other suitable shape. In various embodiments, bore 215 may extend only partially to back end 214, such that bore 215 may be open at the front end 213 and may define a wall 217 at back end 214. In various embodiments, bore 215 may extend fully to back end 214, such that bore 215 may be open at both front end 213 and back end 214. In various embodiments, actuation key buttress 212 may further comprise at least one buttress pin aperture 219. Buttress pin aperture 219 may be configured to receive a buttress pin 230 (discussed below). In various embodiments, buttress pin aperture 219 may be disposed on a portion of actuation key buttress 212 configured to surround bore 215. In various embodiments, two buttress pin apertures may be oriented, and disposed opposite one another, about bore 215 such that a buttress pin 230 positioned in the two buttress pin apertures is disposed and/or extends perpendicularly to bore 215.

In various embodiments, the actuation mechanism may comprise, an actuation key 220, and an attachment mechanism configured to detachably couple actuation key 220 to bolt carrier 210. In various embodiments, actuation key 220 may be slid ably inserted into bore 215. In various embodiments, actuation key 220 may comprise a shape complimentary to the space defined by bore 215. For example, in an embodiment having a cylindrical bore, at least a portion of actuation key 220 may be cylindrical. In various embodiments, at least a portion of actuation key 220 may have a diameter suitable to create a friction fit between actuation key 220 and bore 215 in response to actuation key 220 being positioned inside bore 215.

In various embodiments, actuation key 220 may further comprise an actuation key aperture 221. In various embodiments, actuation key aperture 221 may be configured to receive buttress pin 230. For example, actuation key aperture 221 may be disposed on a portion of actuation key 220 configured to be positioned inside bore 215 and to be in axial alignment with at least one buttress pin aperture 219 along buttress axis 216.

In various embodiments, the attachment mechanism may comprise a buttress pin 230. In various embodiments, buttress pin 230 may have a length approximately equal to the width of the actuation key buttress 212. In various embodiments, buttress pin 230 may be configured to be concurrently disposed in at least one buttress pin aperture 219 and actuation key aperture 221, thereby operatively coupling actuation key 220 to actuation key buttress 212. That being said, the attachment mechanism may comprise any means of detachably coupling actuation key 220 to actuation key buttress 212. For example, the attachment mechanism may comprise a friction fit between actuation key 220 and actuation key buttress 212, an adhesive screw, and/or the like.

In various embodiments, actuation key 220 may comprise a piston strike face 222. Piston strike face 222 may be configured for operation in a gas piston firearm. In various embodiments, piston strike face 222 may be disposed on a forward end of actuation key 220 and may be oriented in a plane substantially perpendicular to buttress axis 216. In various embodiments, piston strike face 222 may comprise a flat or generally planar surface. In various embodiments, piston strike face 222 may comprise a recess, a curved surface, or any other suitable surface. Piston strike face 222 may be configured to receive an impact from a piston rod or other mechanical component of a firearm.

Figure 3A:
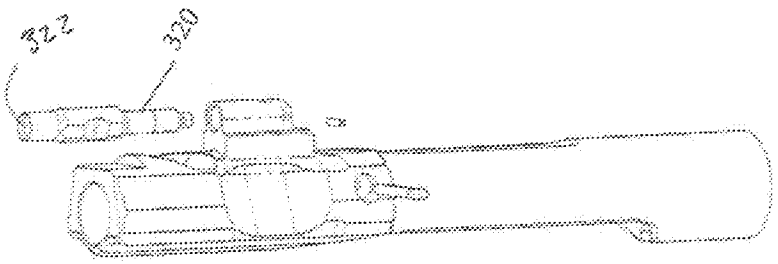
FIG. 3A illustrates a perspective view of an unassembled bolt carrier assembly kit.
Figure 3C:
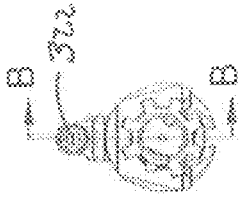
FIG. 3C illustrates a front view of an assembled bolt carrier assembly kit.
Figure 3B:
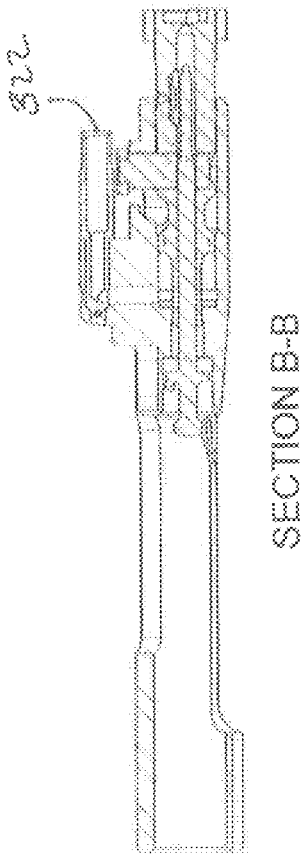
FIG. 3B illustrates a cross-section view of an assembled bolt carrier assembly kit.

In various embodiments and with reference to FIGS. 3A, 3B, and 3C, the actuation mechanism may comprise an actuation key 320, and an attachment mechanism configured to detachably couple actuation key 320 to a bolt carrier. In various embodiments, actuation key 320 may be configured for operation in a direct impingement fir arm. In various embodiments actuation key 320 may comprise a length greater than actuation key 220.

In various embodiments, actuation key 320 may comprise a direct impingement face 322. Direct impingement face 322 may be configured for operation in a direct impingement firearm. In various embodiments, direct impingement face 322 may be disposed on a forward end of actuation key 320 and may be oriented in a plane substantially perpendicular to buttress axis 216. In various embodiments, direct impingement face 322 may be disposed in a bore or recess that is disposed on a forward end of actuation key 320. In various embodiments, actuation key 320 may be configured so that expanding gas from a firearm enters the bore or recess of actuation key 320 and applies force to direct impingement face 322.

In various embodiments, direct impingement face 322 may comprise a flat or generally planar surface. In various embodiments, direct impingement face 322 may comprise a recess, a curved surface, or any other suitable surface. Direct impingement face 322 may be configured to receive an impact from pressurized gas.

Figure 4C:
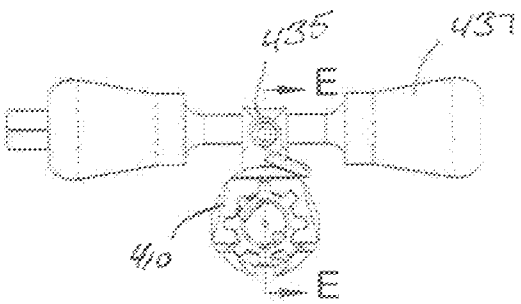
FIG. 4C illustrates a front view of an assembled bolt carrier assembly kit.
Figure 4B:
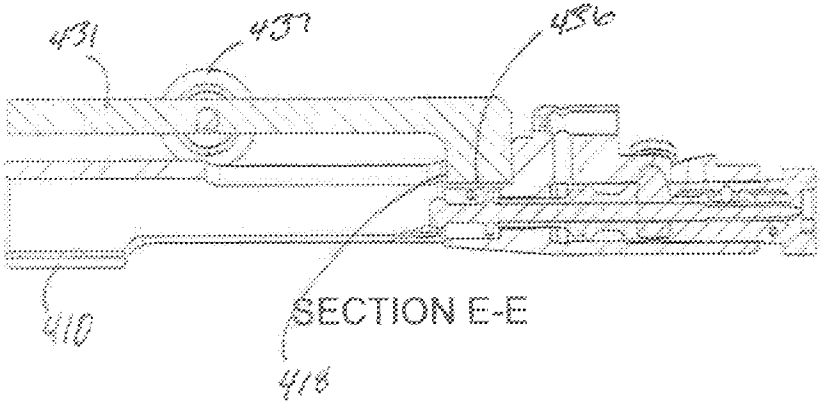
FIG. 4B illustrates a cross-section view of an assembled bolt carrier assembly kit.

In various embodiments and with reference to FIGS. 4A, 4B, and 4C, the actuation mechanism may comprise a manual bolt actuator 430. In various embodiments, manual bolt actuator 430 may comprise a connecting portion 431, a joining portion 435, and at least one handle 437. In various embodiments, connecting portion 431 may further comprise a front portion 432, a back portion 433, and a midpoint 434 disposed between front portion 432 and back portion 433. In various embodiments, joining portion 435 may be disposed at front portion 432 and may further comprise a joining face 436. In various embodiments, handle 437 may be disposed at midpoint 434 and may extend in a substantially perpendicular direction from connecting portion 431.

In various embodiments, joining portion 435 may be configured to detachably couple manual bolt actuator 430 and manual bolt actuator pocket 418 disposed in outer surface 411 of bolt carrier 410. In various embodiments, joining portion 435 may comprise a three-dimensional shape and/or volume substantially similar to the profile of manual bolt actuator pocket 418. For example, in various embodiments, the shape and/or volume of joining portion 435 and the profile of manual bolt actuator pocket 418 may both be cuboidal, conical, or any other complimentary shapes. In various embodiments, joining face 436 may comprise a shape substantially similar to the profile of manual bolt actuator pocket 418. For example, in various embodiments, the shape of joining face 436 and the profile of manual bolt actuator pocket 218 may both be square, circular, or any other complimentary shapes.

In various embodiments, a friction fit may be created between manual bolt actuator 430 and manual bolt actuator pocket 418 in response to joining portion 435 being positioned within manual bolt actuator pocket 418. In such embodiments, the friction fit may operatively couple manual bolt actuator 430 to bolt carrier 410. In various embodiments, manual bolt actuator 430 may be operatively coupled to bolt carrier 410 by a receiver body 102 (with momentary reference to FIG. 1), by an adhesive, by a pin, and/or by any other suitable means of operatively and detachably coupling manual bolt actuator 430 to the bolt carrier 410.

Figure 5:
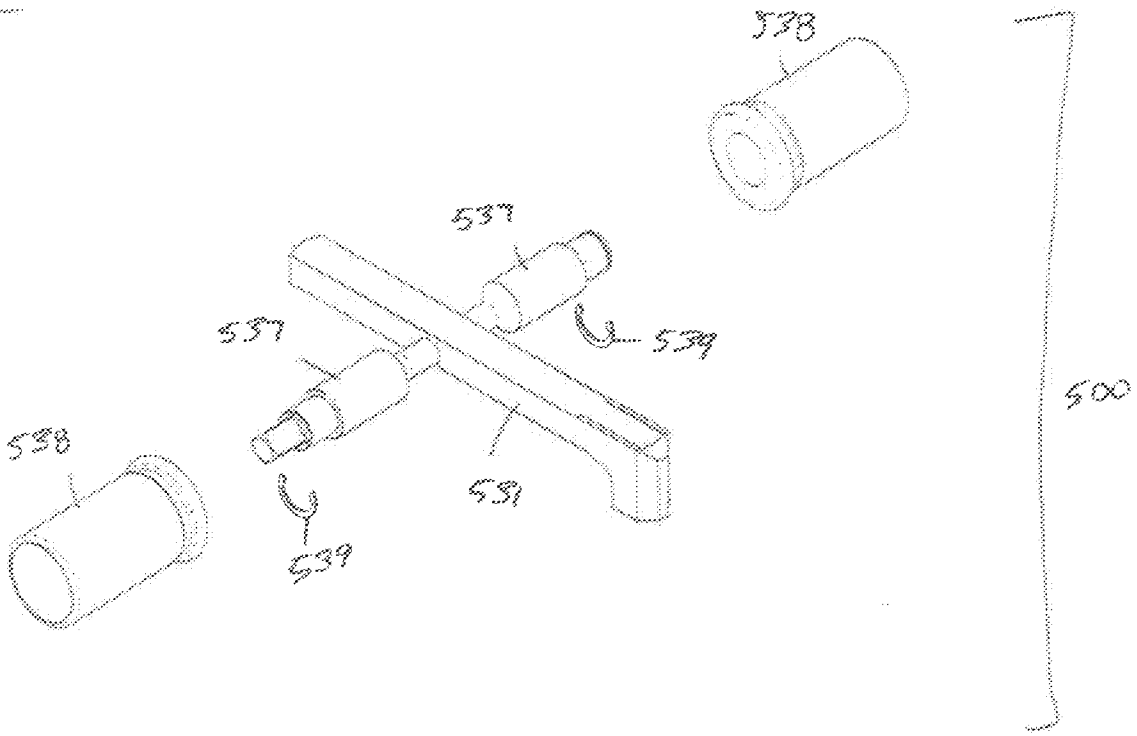
FIG. 5 illustrates a perspective vie r of an exploded manual bolt actuator.

In various embodiments, a manual bolt actuator may comprise a unitary member. In various embodiments and with reference to FIG. 5, a manual bolt actuator 500 may comprise a connecting portion 531, at least one handle spoke 537, and at least one handle grip 538. In various embodiments, handle spoke 537 may be disposed at any point on connecting portion 531 and may extend in a substantially perpendicular direction therefrom. In various embodiments, handle grip 538 may be operative coupled to handle spoke 537 by a c-clip 539. However, any suitable means of operatively coupling a handle grip to a handle spoke may be employed.

In various embodiments, a method of assembling a bolt carrier assembly may comprise providing a bolt carrier assembly kit. The bolt carrier assembly kit may comprise a bolt carrier and at least one actuation mechanism as described herein. In various embodiments, the bolt carrier assembly kit may comprise a bolt carrier and a variety of actuation mechanisms as described herein.

In various embodiments, the method may further comprise determining to assemble a first bolt carrier assembly comprising at least one of a manual bolt firearm bolt carrier assembly, a direct impingement firearm bolt carrier assembly, and a gas piston firearm bolt carrier assembly. In various embodiments, the method may further comprise selecting bolt carrier assembly components, and assembling the first bolt carrier assembly. In various embodiments, the bolt carrier assembly components selected may comprise a bolt carrier and a manual bolt actuator, in response to determining a manual bolt firearm. In various embodiments, the bolt carrier assembly components selected may comprise a bolt carrier and an actuation key, wherein the actuation key comprises a direct impingement face, in response to determining a direct impingement firearm. In various embodiments, the bolt carrier assembly components selected may comprise a bolt carrier and an actuation key, wherein the actuation key comprises a gas piston strike face, in response to determining a gas piston firearm.

In various embodiments, the method may further comprise positioning an actuation key in a bore such that the actuation key is surrounded by an actuation key buttress, positioning the actuation key such that an actuation key aperture is axially aligned with a buttress pin aperture, and placing a buttress pin through the actuation key aperture and the buttress pin aperture. Alternatively, the method may further comprise positioning a joining portion of a manual bolt actuator in a manual bolt actuator pocket of the bolt carrier, detachably coupling the manual bolt actuator to the bolt carrier, and positioning a receiver body around at least a portion of the manual bolt actuator and the bolt carrier such that the manual bolt actuator is operatively coupled to the bolt carrier.

In various embodiments, the method may further comprise disassembling and reassembling the bolt carrier assembly to be compatible with a different firearm. For example, the method may further comprise determining a first type of firearm with which the first bolt carrier assembly is compatible, disassembling the first bolt carrier assembly, selecting bolt carrier assembly components compatible with a second type of firearm, and assembling a second bolt carrier assembly.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Methods and systems are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises" "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A bolt carrier assembly kit for a firearm, comprising:

a bolt carrier comprising:

an outer surface; and an actuation key buttress disposed on the outer surface, and having a front end, a back end, and a bore extending from the front end at least partially along an axis towards the back end;

a direct impingement actuation key comprising a direct impingement actuation key shape complementary to the bore, such that the direct impingement actuation key can be disposed within the bore and coupled to the actuation key buttress, wherein the actuation key comprises a direct impingement face disposed on a forward end of the direct impingement actuation key, wherein the direct impingement actuation key is configured to operate a bolt carrier assembly as part of a direct impingement operating system of the firearm while disposed in the bore, wherein the direct impingement face is configured to receive expanding gas in response to firing a cartridge from the firearm to apply a force in a rearward direction on the direct impingement face; and a gas piston actuation key comprising a gas piston actuation key shape complementary to the bore, such that the gas piston actuation key can be disposed within the bore and coupled to the actuation key buttress, wherein the actuation key comprises a piston strike face disposed on a forward end of the gas piston actuation key, wherein the gas piston actuation key is configured to operate the bolt carrier assembly as part of a gas piston operating system of the firearm while disposed in the bore, wherein the piston strike face is configured to receive an impact from a piston rod in response to firing a cartridge from the firearm to apply a force in the rearward direction on the piston strike face, wherein the direct impingement actuation key and the gas piston actuation key are interchangeable within the bore.

2. The bolt carrier assembly kit of claim 1, further comprising a receiver body, wherein the bolt carrier is disposed within the receiver body.

3. The bolt carrier assembly kit of claim 1, further comprising an attachment mechanism by which the direct impingement actuation key and the gas piston actuation key is coupled to the bolt carrier.

4. The bolt carrier assembly kit of claim 3, wherein the actuation key buttress further comprises a buttress pin aperture; and the attachment mechanism comprises a buttress pin disposed through the buttress pin aperture detachably coupling the direct impingement actuation key or the gas piston actuation key to the bolt carrier.

5. The bolt carrier assembly kit of claim 4, wherein the direct impingement actuation key and the gas piston actuation key each comprise an actuation key aperture through which the buttress pin is disposed.

6. The bolt carrier assembly kit of claim 1, wherein at least one of the direct impingement face or the piston strike face comprises a flat surface.

7. The bolt carrier assembly kit of claim 1, wherein at least one of the direct impingement face comprises a face bore recessed into the direct impingement actuation key or the piston strike face comprises a face bore recessed into the gas piston actuation key.

8. The bolt carrier assembly kit of claim 1, wherein at least one of the direct impingement face or the piston strike face comprises a curved surface.

9. A firearm upper receiver kit, comprising:

a receiver body;

a bolt carrier configured to be disposed in the receiver body, the bolt carrier comprising:

an outer surface; and an actuation key buttress, wherein the actuation key buttress is disposed on the outer surface and comprises a front end, a back end, and a bore extending from the front end at least partially along an axis towards the back end;

a direct impingement actuation key comprising a direct impingement actuation key shape complementary to the bore, such that the direct impingement actuation key can be disposed within the bore and coupled to the actuation key buttress, wherein the actuation key comprises a direct impingement face disposed on a forward end of the direct impingement actuation key, wherein the direct impingement actuation key is configured to operate a bolt carrier assembly as part of a direct impingement operating system of a firearm while disposed in the bore, wherein the direct impingement face is configured to receive expanding gas in response to firing a cartridge from the firearm to apply a force in a rearward direction on the direct impingement face; and a gas piston actuation key comprising a gas piston actuation key shape complementary to the bore, such that the gas piston actuation key can be disposed within the bore and coupled to the actuation key buttress, wherein the actuation key comprises a piston strike face disposed on a forward end of the gas piston actuation key, wherein the gas piston actuation key is configured to operate the bolt carrier assembly as part of a gas piston operating system of the firearm while disposed in the bore, wherein the piston strike face is configured to receive an impact from a piston rod in response to firing a cartridge from the firearm to apply a force in the rearward direction on the piston strike face, wherein the direct impingement actuation key and the gas piston actuation key are interchangeable within the bore.

10. The firearm upper receiver kit of claim 9, wherein the actuation key buttress further comprises a buttress pin aperture.

11. The firearm upper receiver kit of claim 10, wherein a buttress pin is disposed in the buttress pin aperture, detachably coupling the direct impingement actuation key or the gas piston actuation key disposed in the bore and the buttress pin to the bolt carrier.

12. The firearm upper receiver kit of claim 11, wherein the direct impingement actuation key and the gas piston actuation key each comprise an actuation key aperture through which the buttress pin is disposed.

13. The firearm upper receiver kit of claim 9, wherein at least one of the direct impingement face or the piston strike face comprises a flat surface.

14. The firearm upper receiver kit of claim 9, wherein at least one of the direct impingement face comprises a face bore recessed into the direct impingement actuation key or the piston strike face comprises a face bore recessed into the gas piston actuation key.

15. The firearm upper receiver kit of claim 9, wherein at least one of the direct impingement face or the piston strike face comprises a curved surface.

* * * * *